US011725865B2

(12) United States Patent
Yoo et al.

(10) Patent No.: US 11,725,865 B2
(45) Date of Patent: Aug. 15, 2023

(54) REFRIGERATOR DRAIN SYSTEM

(71) Applicant: LG Electronics Inc., Seoul (KR)

(72) Inventors: Daehyun Yoo, Seoul (KR); Kiyoung Lim, Seoul (KR); Kihyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 379 days.

(21) Appl. No.: 16/979,813

(22) PCT Filed: Mar. 6, 2019

(86) PCT No.: PCT/KR2019/002627
§ 371 (c)(1),
(2) Date: Sep. 10, 2020

(87) PCT Pub. No.: WO2019/177304
PCT Pub. Date: Sep. 19, 2019

(65) Prior Publication Data

US 2021/0108850 A1 Apr. 15, 2021

(30) Foreign Application Priority Data

Mar. 12, 2018 (KR) ..... 10-2018-0028783

(51) Int. Cl.
*F25D 21/14* (2006.01)
*F25B 21/04* (2006.01)
(Continued)

(52) U.S. Cl.
CPC ..... *F25D 21/14* (2013.01); *F25B 21/04* (2013.01); *F25D 21/08* (2013.01); *F25D 23/003* (2013.01);
(Continued)

(58) Field of Classification Search
CPC ..... F25D 21/14; F25D 2321/141; F25D 2321/142; F25D 2321/146; F25D 2323/00284; F25D 2321/1441
See application file for complete search history.

(56) References Cited

U.S. PATENT DOCUMENTS 4,843,835 A * 7/1989 Goetz ..... F25D 21/14 62/291
5,499,514 A * 3/1996 Ho ..... F25D 21/14 62/410
(Continued)

FOREIGN PATENT DOCUMENTS

EP 1304534 3/2008
JP S38-18487 9/1963
(Continued)

OTHER PUBLICATIONS

Australian Examination Report in AU Appln. No. 2019235965, dated Dec. 22, 2020, 5 pages.
(Continued)

*Primary Examiner* — Lionel Nouketcha
(74) *Attorney, Agent, or Firm* — Fish & Richardson P.C.

(57) ABSTRACT

A refrigerator includes: a cabinet including an inner case provided with a storage compartment, a case supporter coupled to a lower side of the inner case to support the inner case, and a base coupled to a lower side of the case supporter; a door disposed on a front portion of the cabinet to open and close the storage compartment; and a cooling device disposed on a rear surface of the inner case to have at least a portion thereof exposed to the storage compartment, wherein a water collection hole is formed on a rear end of a bottom surface of the inner case, wherein a water collection guide is mounted on the inner case to guide water flowing into the water collection hole to flow downward,
(Continued)

wherein a water collection portion is formed on the base to collect water passing through the water collection guide.

14 Claims, 11 Drawing Sheets

(51) Int. Cl.

| | |
|---|---|
| ***F25D 23/00*** | (2006.01) |
| ***F25D 21/08*** | (2006.01) |
| ***F25D 23/02*** | (2006.01) |
| ***F25D 25/02*** | (2006.01) |

(52) U.S. Cl.
CPC ..... *F25D 23/021* (2013.01); *F25D 25/025* (2013.01); *F25D 2321/141* (2013.01); *F25D 2321/142* (2013.01); *F25D 2321/146* (2013.01); *F25D 2321/1441* (2013.01); *F25D 2323/00284* (2013.01); *F25D 2400/18* (2013.01); *F25D 2700/02* (2013.01)

(56) References Cited

U.S. PATENT DOCUMENTS

| | | | | |
|---|---|---|---|---|
| 2008/0078197 | A1* | 4/2008 | Jang | F25D 21/14 62/285 |
| 2009/0145138 | A1 | 6/2009 | Ethier et al. | |

FOREIGN PATENT DOCUMENTS

| | | |
|---|---|---|
| JP | 42-8463 | 3/1968 |
| JP | 55-121180 | 8/1980 |
| JP | H06159907 | 6/1994 |
| JP | H0727469 | 1/1995 |
| JP | 7-180948 | 7/1995 |
| JP | H10122726 | 5/1998 |
| JP | H11304345 | 11/1999 |
| JP | 2003227678 | 8/2003 |
| JP | 2006336956 | 12/2006 |
| JP | 2006337012 | 12/2006 |
| JP | 2017072306 | 4/2017 |
| KR | 20030063997 | 7/2003 |
| KR | 20040080028 | 9/2004 |
| KR | 1020070047896 | 5/2007 |
| KR | 101323876 | 10/2013 |
| RU | 2174656 | 10/2001 |
| RU | 2008111575 | 10/2009 |
| WO | WO2017060066 | 4/2017 |

OTHER PUBLICATIONS

JP Office Action in Japanese Appln. No. 2020-528162, dated May 11, 2021, 10 pages (with English translation).
RU Notice of Allowance in Russian Appln. No. 2020131742, dated Jan. 11, 2021, 5 pages.
EP Extended European Search Report in European Appln. No. 19767096.1, dated Jul. 16, 2021, 8 pages.

* cited by examiner

REFRIGERATOR DRAIN SYSTEM

CROSS-REFERENCE TO RELATED APPLICATIONS

This application is a National Stage application under 35 U.S.C. § 371 of International Application No. PCT/KR2019/002627, filed on Mar. 6, 2019, which claims the benefit of Korean Patent Application No. 10-2018-0028783, filed on Mar. 12, 2018. The disclosures of the prior applications are incorporated by reference in their entirety.

TECHNICAL FIELD

The present disclosure relates to a refrigerator.

BACKGROUND ART

In general, a refrigerator refers to a home appliance that can store objects such as foods in a storage compartment provided in a cabinet at a low temperature. The storage compartment is surrounded by an insulation wall and thus the inside of the storage compartment is maintained at a temperature lower than an external temperature.

The storage compartment is divided into a refrigerator compartment or a freezer compartment according to a temperature band of the storage compartment. In addition, foods may be stored in the refrigerator compartment or the freezer compartment according to types or states of foods.

The refrigerator may be provided in a built-in type along with other home appliances in a kitchen. In this case, the exterior of the refrigerator is designed to be well harmonized with furniture of the kitchen.

In addition, according to users' various demands in recent years, refrigerators are increasingly installed and used in other places than kitchens, such as living rooms or bedrooms.

As the installation positions of the refrigerator are diversifying, the exterior of the refrigerator is designed to be well harmonized with furniture in a space where the refrigerator is to be installed.

As a prior art document, Korean Patent Publication No. 10-1323876 discloses a cooling packaging provided with a thermoelement and a refrigerator having the same.

The refrigerator of the prior art document includes: a refrigerator main body having a refrigerator compartment formed therein; a door pivotably installed on the refrigerator main body to open and close the refrigerator compartment; a cooling packaging coupled to a main body coupling hole and provided with a thermoelement; a heat absorption unit coupled to a front end of the cooling packaging in the refrigerator compartment; a radiation unit coupled to a rear end of the cooling packaging at a rear side of the refrigerator main body; and a drain to drain condensate water generated in the refrigerator compartment to the radiation unit by using the capillary phenomenon.

When the cooling packaging provided with the thermoelement is used as in the case of the prior art document, there is an advantage that the size of the refrigerator can be reduced.

However, in the case of the above-described refrigerator, condensate water and defrost water may be generated in a storage compartment of the refrigerator, and it is necessary to apply a drain structure to discharge the generated condensate water and defrost water to the outside of the storage compartment to prevent collection of the water in the storage compartment.

DISCLOSURE OF THE INVENTION

Technical Problem

An object of the present disclosure is to provide a refrigerator which can directly discharge condensate water and defrost water generated in a storage compartment to the outside of the storage compartment.

In addition, an object of the present disclosure is to provide a refrigerator which can discharge condensate water and defrost water generated in a storage compartment to the outside of the storage compartment without leakage.

In addition, an object of the present disclosure is to provide a refrigerator which can evaporate condensate water and defrost water stored in a water collection portion more rapidly, when air of high temperature discharged from a radiation fan of a cooling device passes through the water collection portion.

In addition, an object of the present disclosure is to provide a refrigerator which can rapidly evaporate condensate water and defrost water stored in a water collection portion, and does not require a user to separately empty the condensate water and the defrost water stored in the water collection portion.

In addition, an object of the present disclosure is to provide a refrigerator which does not require a user to separate a base provided with a water collection portion from a cabinet to empty condensate water and defrost water collected in the water collection portion.

In addition, an object of the present disclosure is to provide a refrigerator from which a sensing member for sensing opening of a refrigerator door is not exposed to the outside.

Technical Solution

To achieve the above-described objects, a refrigerator according to the present disclosure includes: a cabinet including an inner case provided with a storage compartment, a case supporter coupled to a lower side of the inner case to support the inner case, and a base coupled to a lower side of the case supporter; a door disposed on a front portion of the cabinet to open and close the storage compartment; and a cooling device disposed on a rear surface of the inner case to have at least a portion thereof exposed to the storage compartment, wherein a water collection hole is formed on a rear end of a bottom surface of the inner case, wherein a water collection guide is mounted on the inner case to guide water flowing into the water collection hole to flow downward, wherein a water collection portion is formed on the base to collect water passing through the water collection guide.

In the present disclosure, the water collection guide includes: a contact portion coupled to an outer surface of the inner case in contact therewith; and a water collection pipe having a guide hole formed in a center thereof to fluidly communicate with the water collection hole.

The contact portion may include: a horizontal contact portion contacting a lower surface of the inner case; and a vertical contact portion extending upward from a rear end of the horizontal contact portion to be in contact with a rear surface of the inner case.

An inclined portion may be formed on an upper end of the water collection pipe, and the inclined portion may become narrower from an upper side toward a lower side.

A guide pipe may be formed on the case supporter to allow the water collection pipe to be inserted thereinto.

The guide pipe may have an upper end extending upward from an upper surface of the case supporter to be connected with a lower end of the water collection pipe, and a lower end extending downward from a lower surface of the case supporter to guide water discharged from the water collection pipe toward the water collection portion.

The water collection portion may have a pipe cover rib formed thereon to allow a lower end of the guide pipe to be inserted.

A slit recess cut in a vertical direction may be formed on the pipe cover rib.

The inner case may have a water collection recess formed on an inner surface thereof on which the cooling device is installed, and the water collection recess may be formed to be concave backward to guide water generated in the cooling device to flow toward the water collection hole.

A width of an upper end of the water collection recess may be formed to correspond to a width of the cooling device, and a width of a lower end of the water collection recess may be formed to correspond to a width of the water collection hole.

The water collection recess may be formed to have a width gradually becoming smaller from an upper end to a lower end.

The cooling device may include a radiation fan protruding backward from the inner case, and air discharged from the radiation fan may pass through the water collection portion, and then is discharged an outside of the cabinet.

The cabinet may further include a middle plate to cover an upper surface and a rear surface of the inner case, and a rear panel to cover a rear surface of the middle plate. The radiation fan may be disposed between the middle plate and the rear panel, and air discharged from the radiation fan may move downward between the middle plate and the rear panel, and then may move forward between the case supporter and the base.

The inner case may include an elevated portion protruding upward from a center of the bottom surface thereof in a forward-backward direction, and base portions may be formed on both sides of the elevated portion to be stepped from the elevated portion.

A second sensing member may be disposed on a front surface of the elevated portion, and a first sensing member may be disposed on a position of the door facing the second sensing member.

The first sensing member may be disposed on a lower side of a drawer assembly which is connected to a lower side of the door, and slides forward and backward along with the door.

Advantageous Effects

According to the present disclosure suggested, there is an advantage that condensate water and defrost water generated in the storage compartment can be directly discharged to the outside of the storage compartment.

In addition, according to the present disclosure, there is an advantage that condensate water and defrost water generated in the storage compartment can be discharged to the outside of the storage compartment without leakage.

In addition, according to the present disclosure, there is an advantage that condensate water and defrost water stored in the water collection portion can be more rapidly evaporated when air of high temperature discharged from the radiation fan of the cooling device passes through the water collection portion.

In addition, according to the present disclosure, there is an advantage that condensate water and defrost water stored in the water collection portion rapidly evaporate, and also, a user is not required to separately empty the condensate water and the defrost water stored in the water collection portion.

In addition, according to the present disclosure, there is an advantage that the user is not required to separate the base provided with the water collection portion from the cabinet to empty condensate water and defrost water collected in the water collection portion.

In addition, according to the present disclosure, the sensing member for sensing opening of the refrigerator door is not exposed to the outside, and accordingly, there is an advantage that the exterior is aesthetic.

BEST MODE

Hereinafter, embodiments of the present disclosure will be described in detail with reference to the accompanying drawings.

Figure 1:
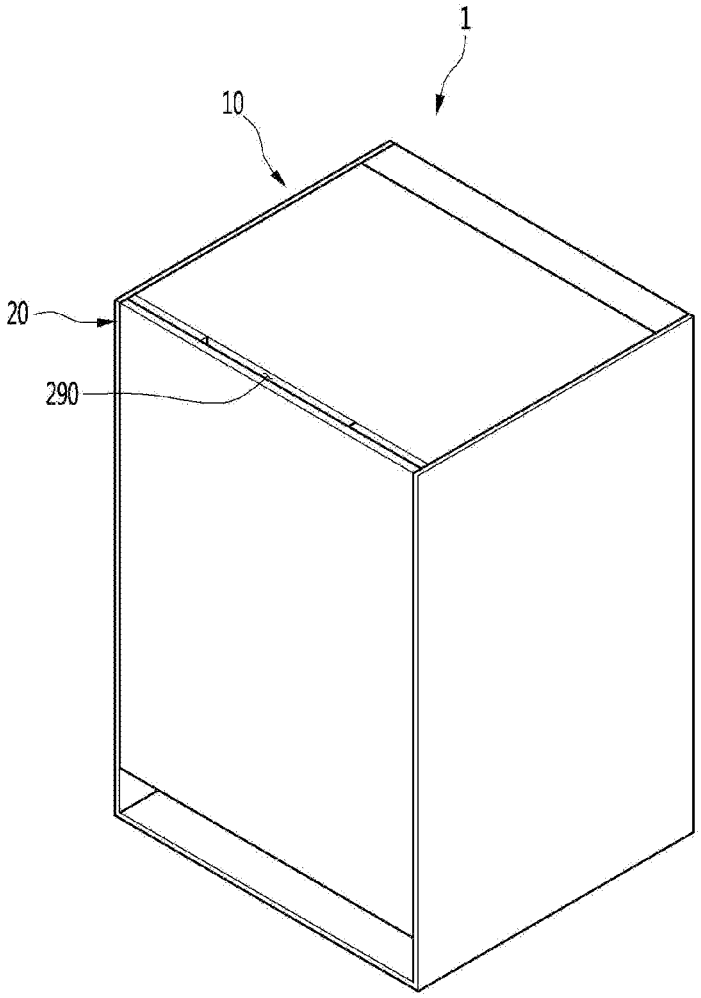
FIG. 1 is a perspective view of a refrigerator according to an embodiment of the present disclosure.
Figure 2:
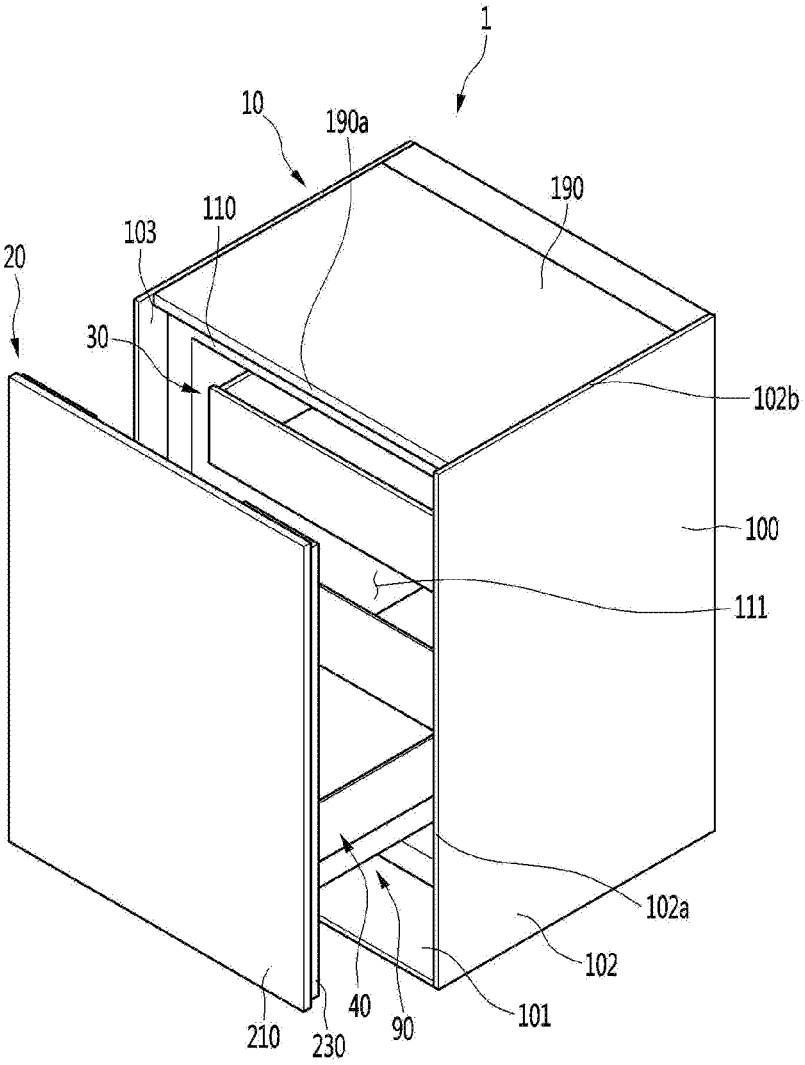
FIG. 2 is a perspective view showing a state in which a door of FIG. 1 is opened.
Figure 3:
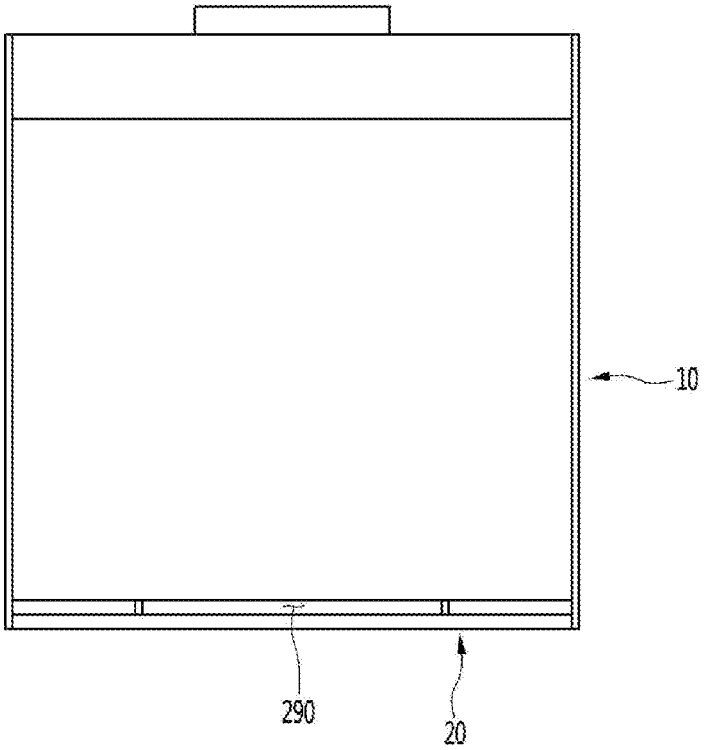
FIG. 3 is a top view of the refrigerator of FIG. 1.

FIG. 1 is a perspective view of a refrigerator according to an embodiment of the present disclosure, FIG. 2 is a perspective view illustrating a state in which a door of FIG. 1 is opened, and FIG. 3 is a top view of the refrigerator of FIG. 1.

Referring to FIGS. 1 to 3, the refrigerator 1 according to an embodiment of the present disclosure may include a cabinet provided with a storage compartment 111, and a door 20 connected to the cabinet 10 to open and close the storage compartment 111.

The cabinet 10 may include an inner case 110 defining the storage compartment 111, and an outer case surrounding the inner case 110.

The outer case 100 may be formed with a metallic material. For example, the outer case 100 may have an aluminum (Al) material. The outer case 100 may be formed by curving or bending at least two times. Alternatively, the outer case 100 may be formed by bonding a plurality of metal plates.

For example, the outer case 100 may include one pair of side panels 102, 103.

The inner case 110 may be positioned between the one pair of side panels 102, 103, and in this state, may be directly or indirectly fixed to the outer case 100.

Front ends 102*a* of the one pair of side panels 102, 103 may be positioned ahead of a front surface of the inner case 110.

In addition, a width of the door 20 in the horizontal direction may be the same as or shorter than a distance between the one pair of side panels 102, 103.

Accordingly, there may be a space between the one pair of side panels 102, 103 to allow the door 20 to be positioned therein.

For example, in a state in which the door 20 closes the storage compartment 111, the door 20 may be positioned between the one pair of side panels 102, 103.

In this case, a front surface of the door 20 may be positioned on the same plane as the front end 102*a* of each of the side panels 102, 103, such that the door 20 and the exterior of the cabinet 10 have a unity when the door 20 closes the storage compartment 111.

That is, the front surface of the door 20 and the front end 102*a* of each of the side panels 102, 103 may define a front surface exterior of the refrigerator 1.

The door 20 may be connected to the cabinet 10 by a rail assembly 90, for example.

Accordingly, the door 20 may be connected to the cabinet 10, and in this state, may slide forward and backward, thereby opening and closing the storage compartment 111.

According to the present disclosure, there is an advantage that, even when the refrigerator 1 is placed in a small space of a kitchen, a living room, or a bedroom, the door 20 can be opened and closed without interfering with other surrounding structures since the door 20 opens and closes the storage compartment 111 in a sliding manner.

The rail assembly 90 may have one side connected to the door 20 and the other side connected to the inner case 110.

The door 20 may include a front surface panel 210 of a wood material, and a door liner 230 coupled to a rear surface of the front surface panel 210.

The front surface panel 210 and the door liner 230 may be fastened to each other by a fastening member such as a screw. The front surface panel 210 and the door liner 230 may have a foaming space, and an insulator may be provided between the front surface panel 210 and the door liner 230 by filling the foaming space with a foam liquid.

The door 20 may define a handle space 290 to allow a user's hand to be putted thereinto and to hold the door 20 to open the door 20.

The handle space 290 may be formed by denting down a part of the upper side of the door liner 230, for example.

The handle space 290 may be positioned between the front surface panel 210 and the cabinet 10 in the state in which the door 20 closes the storage compartment 111. Accordingly, in the state in which the door 20 closes the storage compartment 111, the user may put user's hand into the handle space 290 and then open the door 20 by pulling the door 20.

According to the present invention, when the door 20 is closed, a structure like a handle does not protrude outward and thus there is an advantage that an aesthetic design of the refrigerator 1 can be achieved.

A height of the refrigerator 1 is not limited, but may be lower than the average adult's height. As a capacity of the refrigerator 1 is lower, the height of the refrigerator 1 may be lower.

When there exists the handle space 290 on an upper side of the door 20 as described above, the user can easily open the door 20 while the user is standing or seated, even if the height of the refrigerator 1 is reduced.

Upper ends 102*b* of the one pair of side panels 102, 103 may be positioned higher than an upper end of the inner case 110.

Accordingly, a space may be formed on an upper side of the inner case 110, and a cabinet cover 190 may be positioned on the space. The cabinet cover 190 may define an exterior of an upper surface of the cabinet 10. That is, the cabinet cover 190 may define an exterior of an upper surface of the refrigerator 1.

The cabinet cover 190 may be directly fixed to the inner case 110 or may be fixed to a middle plate 150 surrounding the inner case 110.

The cabinet cover 190 may be positioned between the one pair of side panels 102, 103 while covering the inner case 110.

In addition, an upper surface of the cabinet cover 190 may be positioned on the same plane or at the same height as the upper ends 102*b* of the side panels 102, 103, such that the cabinet cover 190 and the exterior of the cabinet 10 have a unity.

The cabinet cover 190 may be formed with a wood material, for example.

According to the present disclosure, since the front surface panel 210 of the door 20 and the cabinet cover 190 are formed with a wood material, respectively, there is an advantage that there is a unity in material between the door 20 and the cabinet cover 190 when the door 20 is closed, and an aesthetic design can be achieved.

Furthermore, when the height of the refrigerator is low, the user may check the cabinet cover 190 with user's naked eyes. Since the cabinet cover 190 is formed with a wood material, a basic aesthetic design can be achieved, and also, the refrigerator 1 can be well harmonized with surrounding furniture of a place where the refrigerator 1 is placed.

The refrigerator 1 of the present disclosure may be used as a table-shaped refrigerator, for example.

The table-shaped refrigerator may perform a function of a table in addition to the function of storing foods. Compared to a typical refrigerator installed in a kitchen, the table-shaped refrigerator may be installed and used beside a bed in a bedroom. According to the present disclosure, since the cabinet cover 190 and the front surface panel 210 are formed with a wood material, the refrigerator 1 can be well harmonized with surrounding furniture even when the refrigerator is placed in a bedroom.

It is preferable that the height of the table-shaped refrigerator is similar to a height of a bed for convenience of users, and the table-shaped refrigerator may have a height lower than that of a typical refrigerator and may have a compact size.

A front surface 190*a* of the cabinet cover 190 may be positioned ahead of the front surface of the inner case 110. Accordingly, the cabinet cover 190 may cover a part of the door liner 230 from above when the door 20 closes the storage compartment 111.

The refrigerator 1 may further include one or more drawer assemblies 30, 40 received in the storage compartment 111.

A plurality of drawer assemblies 30, 40 may be provided in the storage compartment 111 for efficiency of a storage space.

Some of the plurality of drawer assemblies 30, 40 may be fixed to positions in the storage compartment 111, or may be connected to a rail to be slidable by the rail.

Alternatively, some of the plurality of drawer assemblies 30, 40 may be connected to the door 20, and may slide in and out along with the door 20.

Alternatively, some of the plurality of drawer assemblies 30, 40 may be configured to slide out along with the door 20 at the beginning of the opening process of the door 20, and to be stopped when it has slid a predetermined distance.

Hereinafter, a structure of the cabinet 10 will be described in detail.

<Structure of the Cabinet>

Figure 4:
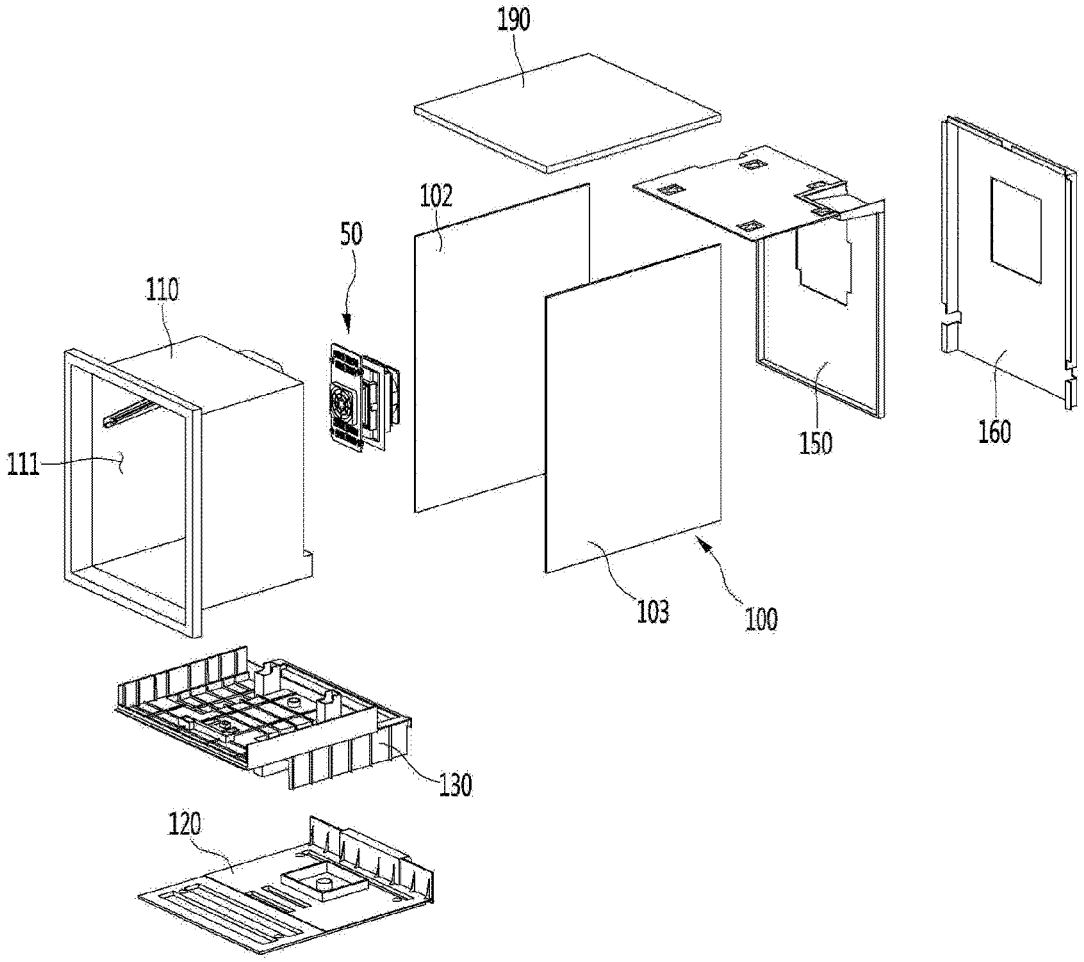
FIG. 4 is an exploded perspective view of a cabinet according to an embodiment of the present disclosure.

FIG. 4 is an exploded perspective view of the cabinet according to an embodiment of the present disclosure.

Referring to FIGS. 1 to 4, the cabinet 10 according to an embodiment of the present disclosure may include the outer case 100, the inner case 110, and the cabinet cover 190.

The outer case 100 may include one pair of side panels 102, 103. The one pair of side panels 102, 102 may define an exterior of a side surface of the refrigerator 1.

The outer case 100 may further include a rear panel 160 defining an exterior of a rear surface of the refrigerator 1.

Accordingly, the exterior of the refrigerator 1 except for the door 20 may be defined by the side panels 102, 103, the cabinet cover 190, and the rear panel 160.

The cabinet 10 may further include a case supporter 130 to support the inner case 110, and a base 120 coupled to a lower side of the case supporter 130.

The cabinet 10 may further include the middle plate 150 to form a foaming space with the inner case 110. The middle plate 150 may cover an upper side and a rear side of the inner case 110 at a position spaced apart from the inner case 110.

The cabinet 10 may further include a cooling device 50 to cool the storage compartment 111.

Figure 5:
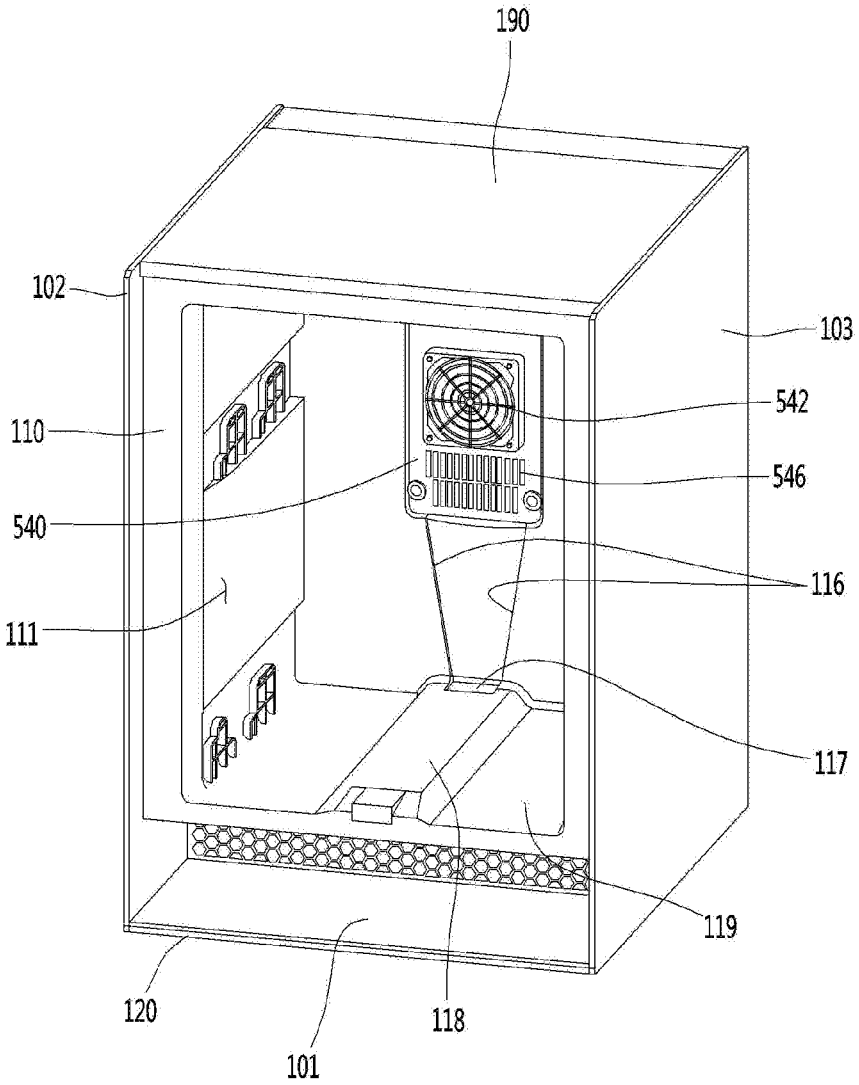
FIG. 5 is a perspective view showing an inside of a storage compartment of the refrigerator.

FIG. 5 is a perspective view showing the inside of the storage compartment of the refrigerator.

The cooling device 50 according to an embodiment of the present disclosure may include a thermoelectric module. The thermoelectric module may cool the storage compartment 111.

The thermoelectric module may maintain the storage compartment 111 at a low temperature by utilizing the Peltier effect. Since the thermoelectric module is well-known technology, a detailed description of the operation principle thereof is omitted.

A part of a front side of the thermoelectric module may be positioned inside the inner case, and a part of a rear side may be positioned outside the inner case.

The thermoelectric module may penetrate through the middle plate 150, and may be positioned ahead of the rear panel 160.

The thermoelectric module may include a thermoelement, a cooling sink, and a heat sink.

The thermoelement may include a low temperature portion and a high temperature portion. The low temperature portion and the high temperature portion may be determined according to a direction of a voltage applied to the thermoelement. The low temperature portion (heat absorption side) of the thermoelement may be positioned closer to the inner case 110 than the high temperature portion (radiation side).

The low temperature portion may be in contact with the cooling sink, and the high temperature portion may be in contact with the heat sink. The cooling sink may cool the storage compartment, and the heat sink may radiate heat.

The cooling device 50 may further include a cooling fan to move air of the storage compartment 111 to the cooling sink of the thermoelectric module, and a radiation fan to move external air to the heat sink of the thermoelectric module.

The cooling fan may be disposed at a front portion of the thermoelectric module, and the radiation fan may be disposed at a rear portion of the thermoelectric module.

The cooling fan may be disposed inside the inner case. The cooling fan may be covered by a fan cover 540.

The fan cover 540 may be disposed inside the inner case 110, and in this state, may be coupled to a rear surface of the inner case 110.

The fan cover 540 may have an inner suction hole 542 and an inner discharge hole 546 formed thereon.

The number, size, and shape of the inner suction hole 542 and the inner discharge hole 546 may vary according to need.

The cooling fan may be disposed to face the inner suction hole 542. When the cooling fan is driven, internal air of the storage compartment 111 may be drawn in through the inner suction hole 542, and may be cooled by heat exchange with the cooling sink. The cooled air may be discharged to the storage compartment 111 through the inner discharge hole 546, and accordingly, the storage compartment 111 can be maintained at a low temperature.

When the cooling device 50 is operated as described above, condensate water may be generated during a cooling process or defrost water may be generated in a defrosting process.

The condensate water and the defrost water generated in the cooling device 50 as described above may be drained into the outside of the storage compartment 111.

Hereinafter, a drain structure of water (condensate water and defrost water) generated in the cooling device 50 installed in the storage compartment 111 will be described in detail.

<Drain Structure>

Figure 6:
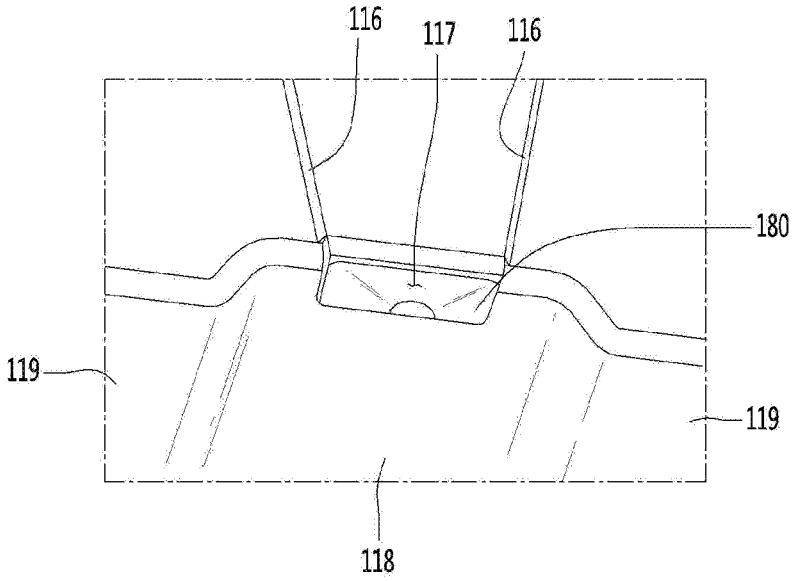
FIG. 6 is a view enlarging some areas extracted from FIG. 5.
Figure 7:
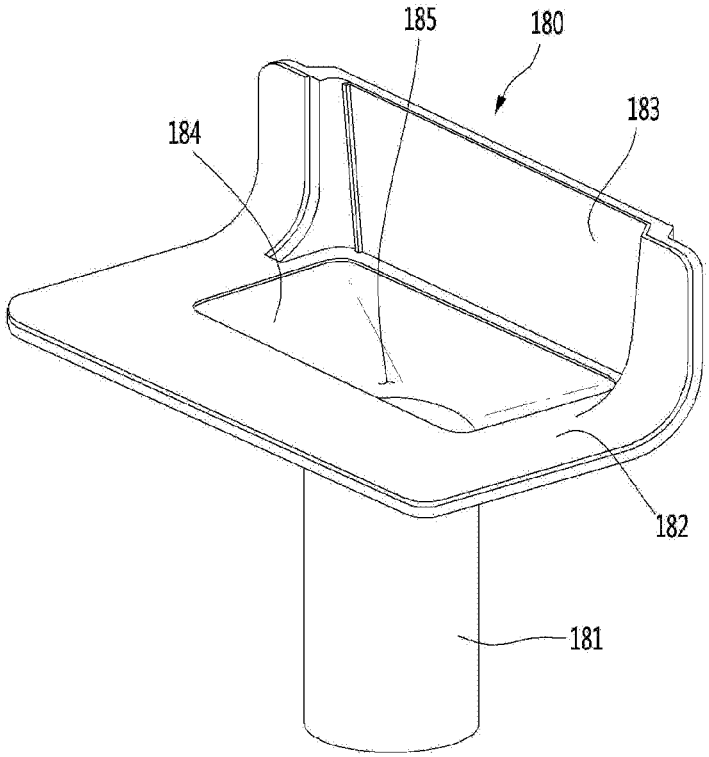
FIG. 7 is a perspective view showing a condensate water discharge pipe extracted from FIG. 5.
Figure 8:
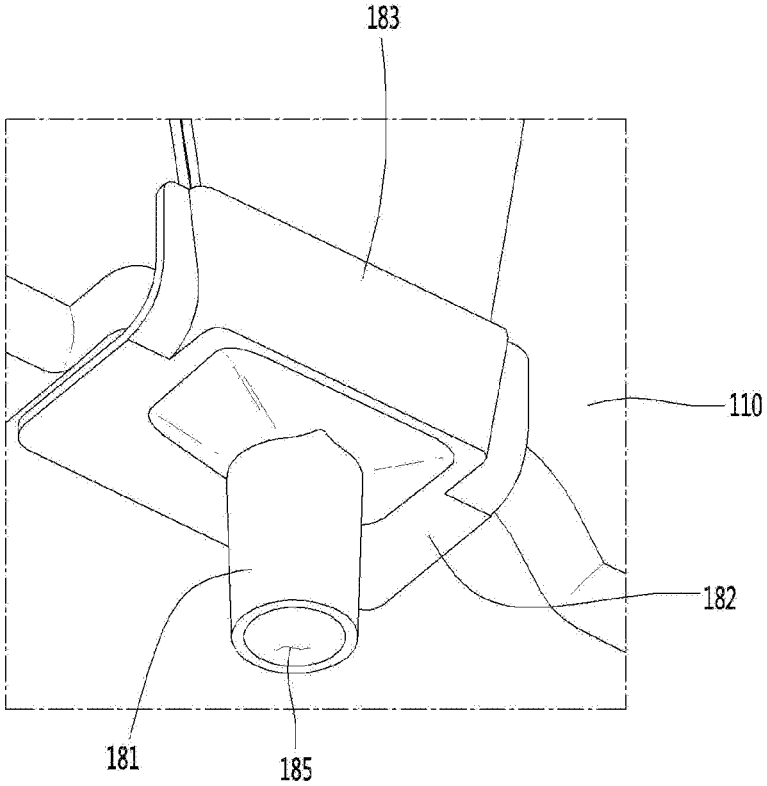
FIG. 8 is a bottom perspective view showing a coupling structure of an inner case and the condensate water discharge pipe.
Figure 9:
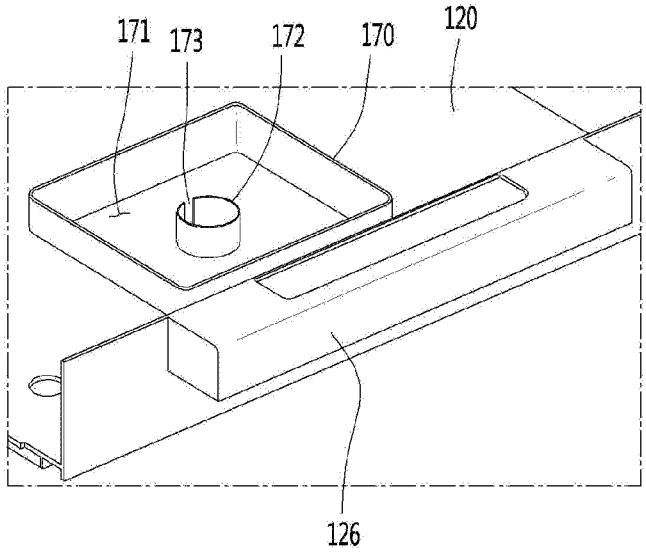
FIG. 9 is a perspective view of a base in which a water collection portion is formed.

FIG. 5 is a perspective view showing the inside of the storage compartment of the refrigerator, FIG. 6 is a view enlarging some areas extracted from FIG. 5, FIG. 7 is a perspective view of a condensate water discharge pipe of FIG. 5, FIG. 8 is a bottom perspective view showing a coupling structure of the inner case and the condensate water discharge pipe, and FIG. 9 is a perspective view of the base in which a water collection portion is formed.

Referring to FIGS. 5 to 9, a water collection hole 117 may be formed on a rear end of a bottom surface of the inner case 110, and a water collection guide 180 may be mounted on a lower side of the inner case 110 to guide water flowing into the water collection hole 117 to move downward, and a water collection portion 170 may be formed in the base 120 to collect water passing through the water collection guide 180.

In this case, water (condensate water and defrost water) generated in the cooling device 50 installed in the storage compartment 111 may move from top to bottom along a rear wall of the storage compartment 111, and may be discharged to the outside of the storage compartment 111 through the water collection hole 117 formed on the center of the rear end of the storage compartment.

In addition, water (condensate water and defrost water) discharged through the water collection hole 117 may move toward the water collection portion 170 through the water collection guide 180.

Thereafter, water (condensate water and defrost water) passing through the water collection guide 180 may be collected in the water collection portion 170 formed in the base 120.

The water collection guide 180 may have at least a part formed in a hollow pipe shape.

The water collection portion 170 may extend upward from an upper surface of the base 120 to define a storage space 171 to store the condensate water and the defrost water. For example, the water collection portion 170 may form a closed curve when viewed from above.

In addition, the water collection guide 180 includes a contact portion 182, 183 coupled to an outer surface of the inner case 110 in surface contact therewith, and a water collection pipe 181 having a guide hole 185 formed on a center thereof to fluidly communicate with the water collection hole 117.

Specifically, the contact portion 182, 183 includes a horizontal contact portion 182 contacting a lower surface of the inner case 110, and a vertical contact portion 183 extending upward from a rear end of the horizontal contact portion 182 and contacting a rear surface of the inner case 110.

The horizontal contact portion 182 and the vertical contact portion 183 may be attached to the outer surface of the inner case 110 through a double-sided tape or the like.

Accordingly, water (condensate water and defrost water) discharged to the outside of the storage compartment 111 through the water collection hole 117 may move downward through the water collection pipe 181 of the water collection guide 180 attached to the outer surface of the inner case 110.

In addition, an inclined portion 184 may be formed on an upper end of the water collection pipe 181 to become narrower from an upper side to a lower side. For example, the inclined portion 184 may have a funnel-like shape having an exit smaller than an entrance.

In this case, the upper end of the water collection pipe 181 may be formed to correspond to a size and a shape of the water collection hole 117.

Accordingly, water discharged through the water collection hole 117 may be more stably introduced to the water collection pipe 181 through the inclined portion 184.

In addition, a guide pipe 137 may be formed on the case supporter 130 to have the water collection pipe 181 to be inserted thereinto.

Specifically, the guide pipe 137 has an upper end extending upward from an upper surface of the case supporter 130 to be connected with a lower end of the water collection pipe 181, and has a lower end extending downward from a lower surface of the case supporter 130 to guide water discharged from the water collection pipe 181 toward the water collection portion 170.

The water (condensate water and defrost water) discharged from the storage compartment 111 and then moved along the water collection pipe 181 may pass through the case supporter 130 and may be guided downward by the guide pipe 137, and as a result, the water may be discharged to the water collection portion 170.

In addition, the lower end of the water collection pipe 181 is inserted into the guide pipe 137, such that a fixing force of the water collection guide 180 can be enhanced.

In the above-described case, the water (condensate water and defrost water) passing through the water collection hole 117 of the storage compartment 111 may pass through the inclined portion 184, the water collection pipe 181, and the guide pipe 137 in sequence, and then may be discharged to the water collection portion 170.

In addition, the water collection portion 170 may have a pipe cover rib 172 into which the lower end of the guide pipe 137 is inserted.

In this case, since the pipe cover rib 172 is disposed to surround a lower end of the guide pipe 137, the condensate water and the defrost water can be prevented from being discharged to the outside of the water collection portion 170 in the process of being stored in the water collection portion 170.

In addition, a coupling force between the case supporter 130 and the base 120 can be enhanced.

In addition, the condensate water and the defrost water discharged to the water collection hole 117 may be collected in the storage space 171 of the water collection portion 170 without leakage through the water collection guide 180, the guide pipe 137, and the pipe cover rib 172.

In addition, the pipe cover rib 172 may have a slit recess 173 cut in the vertical direction.

When the slit recess 173 is formed on the pipe cover rib 172 as described above, water flowing into the pipe cover rib 172 through the guide pipe 137 may be more easily discharged to the outside of the pipe cover rib 172 through the slit recess 173. The water discharged through the slit recess 173 may be stored in the storage space 171 of the water collection portion 170.

In addition, when the slit recess 173 is formed on the pipe cover rib 172 as described above, the slit recess 173 may become wider according to a size of the guide pipe 137, and the guide pipe 137 of various sizes may be connected to the pipe cover rib 172.

In addition, a water collection recess 116 may be formed on an inner surface (rear surface) of the inner case 110 on which the cooling device 50 is installed, and the water collection recess may be formed to be concave backward to guide water generated in the cooling device 50 toward the water collection hole 117.

In this case, a width of an upper end of the water collection recess 116 may correspond to a width of the cooling device 50, and a width of a lower end of the water collection recess 116 may correspond to a width of the water collection hole 117.

Herein, the width of the cooling device 50 may refer to a width of the fan cover 540.

In addition, the water collection recess 116 may be formed to have a width becoming narrower from an upper end to a lower end.

Accordingly, water (condensate water and defrost water) generated in the cooling device 50 does not move to the outside of the water collection recess 116, and moves only along the water collection recess 116. As a result, the water (condensate water and defrost water) generated in the cooling device 50 may be discharged only to the water collection hole 117 through the water collection recess 116. That is, a phenomenon in which water (condensate water and defrost water) generated in the cooling device 50 is not discharged to the water collection hole 117, and is collected on an elevated portion 118 and a base portion 119 formed on a bottom surface of the storage compartment 111 can be prevented.

Figure 10:
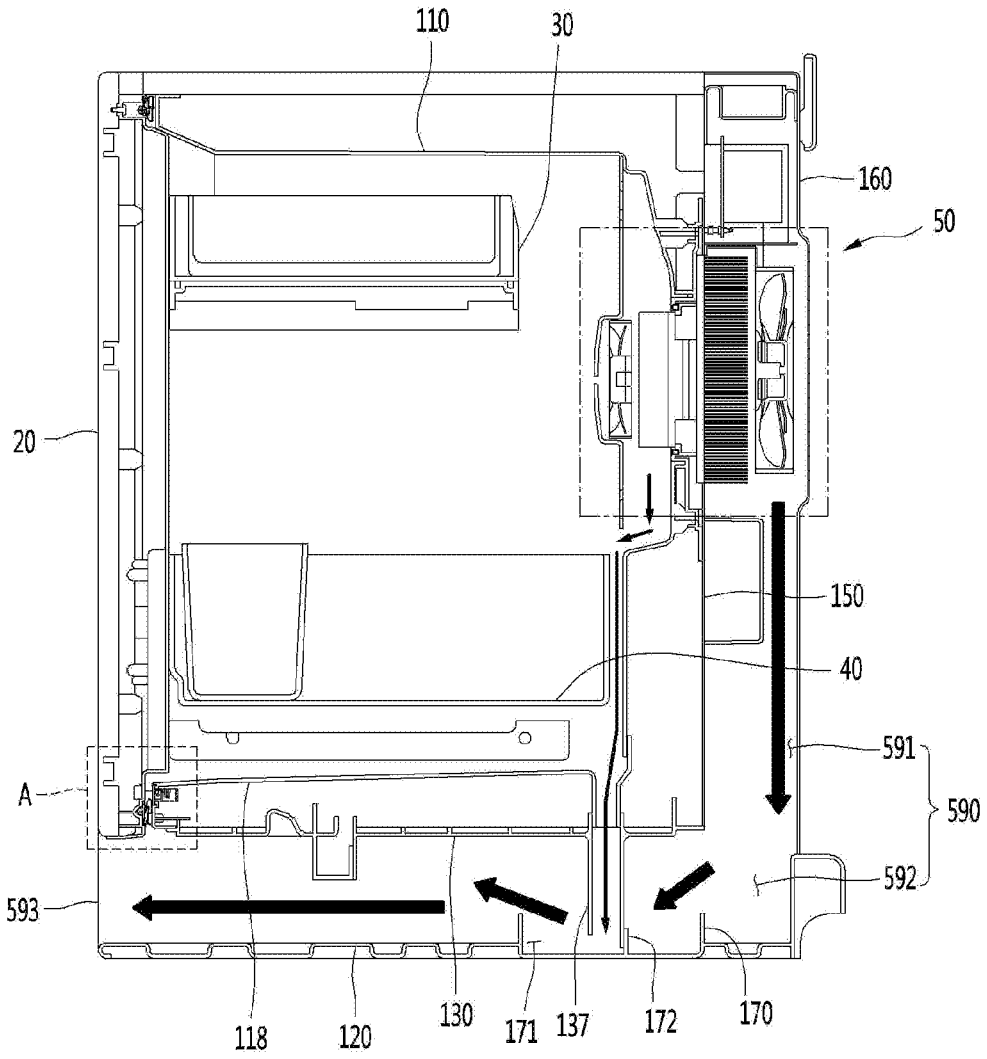
FIG. 10 is a cross-sectional view of the refrigerator according to an embodiment of the present disclosure.
Figure 11:
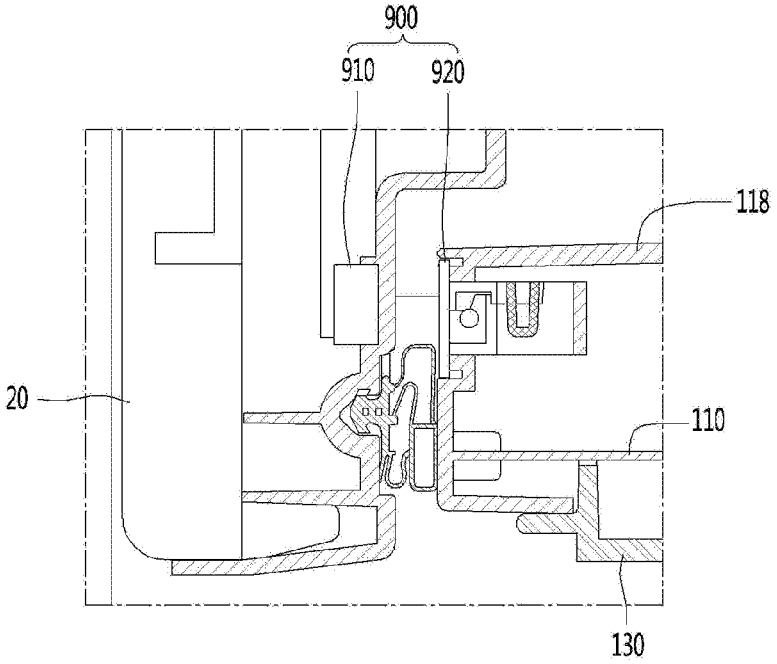
FIG. 11 is a view enlarging the A area of FIG. 10.

FIG. 10 is a cross-sectional view of the refrigerator according to an embodiment of the present disclosure, and FIG. 11 is a view enlarging the A area of FIG. 10

Referring to FIG. 10, the cooling device 50 include a radiation fan protruding toward the rear side of the inner case 110, and hot air discharged from the radiation fan is discharged to the outside of the cabinet 10 after passing through the water collection portion 170.

For example, the cabinet 10 may further include the middle plate 150 to cover the upper surface and the rear surface of the inner case 110, and the rear panel 160 spaced apart from the middle plate 150 to cover the rear surface of the middle plate 150 and to define the rear surface of the cabinet 10. In addition, the radiation fan may be disposed between the middle plate 150 and the rear panel 160, and air of high temperature discharged from the radiation fan moves from top to bottom through a vertical channel formed between the middle plate 150 and the rear panel 160. Thereafter, the air of high temperature moving to a lower side of the vertical channel moves toward the water collection portion 170 through a horizontal channel fluidly communicating with the vertical channel. Specifically, the horizontal channel is formed between the case supporter 130 and the base 120, and the water collection portion 170 is formed on the horizontal channel. The air of high temperature passing through the vertical channel moves from the rear side to the front side along the horizontal channel, and passes through the water collection portion 170, and the air of high temperature passing through the water collection portion 170 is discharged to a lower end of the front surface of the cabinet 10 through a discharge grill installed between the base 120 and the case supporter 130.

When the air of high temperature discharged from the radiation fan passes through the water collection portion 170 as described above, the condensate water and the defrost water stored in the water collection portion 170 may naturally evaporate, and simultaneously, the condensate water and the defrost water stored in the water collection portion 170 may more rapidly evaporate due to the air of high temperature. Accordingly, as the condensate water and the defrost water stored in the water collection portion 170 rapidly evaporate, there is an advantage that a user is not required to separately empty the condensate water and the defrost water stored in the water collection portion 170.

In addition, the user is not required to separate the base 120 provided with the water collection portion 170 from the cabinet 10 to empty the condensate water and the defrost water collected in the water collection portion 170. Therefore, there is an advantage of the simple and stable structure.

The elevated portion 118 protruding upward is formed on the center of the bottom surface of the inner case 10 in the forward-backward direction, and base portions 119 may be formed on both sides of the elevated portion 118 to be stepped from the elevated portion 118.

The elevated portion 118 may be provided to have a second sensing member 920, which will be described later, installed thereon.

In addition, the base portions 119 are formed on both sides of the elevated portion 118 in which a separate sensing member is not installed, such that a capacity of the storage compartment 111 can be increased.

Referring to FIG. 11, a second sensing member 920 may be installed on a front surface of the elevated portion 118, and a first sensing member 910 may be installed on a position of the door 20 facing the second sensing member 920.

In addition, the first sensing member 910 may be installed on a lower side of the drawer assembly 40 which is connected to a lower side of the door 20 to slide forward and backward along with the door 20.

For example, the first sensing member 910 and the second sensing member 920 may be formed with a hall sensor and a magnet, respectively.

When the sensing members 910, 920 are installed on the door 20 and the elevated portion 118 as described above, it may be determined whether the door 20 is opened and closed.

According to the present disclosure, when the first sensing member 910 is installed on the lower side of the drawer assembly 40 as described above, the first sensing member 910 and the second sensing member 920 are not exposed to the outside.

Specifically, when the door 20 is opened forward, the drawer assembly 40 may slide forward along with the door 20, and the first sensing member 190 and the second sensing member 920 may not be exposed by the drawer assembly 40.

To ensure prevention of exposure of the first sensing member 910 and the second sensing member 920, a bottom surface of the drawer assembly 40 may be formed with a translucent material or may have a minute concavo-convex shape.

According to the present disclosure as described above, the condensate water and the defrost water generated in the storage compartment can be directly discharged to the outside of the storage compartment. In addition, when the air of high temperature discharged from the radiation fan of the cooling device passes through the water collection portion, the condensate and the defrost water stored in the water collection portion can be more rapidly evaporated. In addition, as the condensate water and the defrost water stored in the water collection portion rapidly evaporate, there are advantages that the user is not required to empty the condensate water and the defrost water stored in the water collection portion, and also, is not required to separate the base provided with the water collection portion from the cabinet to empty the condensate water and the defrost water stored in the water collection portion.

The invention claimed is:

1. A refrigerator comprising:

a cabinet comprising:

an inner case that defines a storage compartment, the inner case having a bottom surface that defines a water collection hole at a rear end, a case supporter that is coupled to a lower side of the inner case and that supports the inner case, a base that is coupled to a lower side of the case supporter, wherein the base and the case supporter define a cavity therebetween, a water collection guide mounted on the lower side of the inner case and configured to guide water downward from the water collection hole, and a water collection portion disposed on the base and configured to collect water from the water collection guide;

a door disposed on a front portion of the cabinet and configured to open and close at least a portion of the storage compartment; and a cooling device disposed on a rear surface of the inner case, at least a portion of the cooling device being exposed to the storage compartment, wherein the water collection guide comprises:

a contact portion that is coupled to and in contact with an outer surface of the inner case, and a water collection pipe having a guide hole configured to fluidly communicate with the water collection hole, and wherein the contact portion comprises:

a horizontal contact portion that is in contact with a lower surface of the inner case, and a vertical contact portion that extends upward from a rear end of the horizontal contact portion and that is in contact with the rear surface of the inner case.

2. The refrigerator of claim 1, wherein the water collection guide comprises an inclined portion that is disposed at an upper end of the water collection pipe, and wherein an upper width of the inclined portion is greater than a lower width of the inclined portion.

3. The refrigerator of claim 1, wherein the case supporter comprises a guide pipe that receives the water collection pipe.

4. The refrigerator of claim 1, wherein the inner case further comprises:

an elevated portion that protrudes upward from a center portion of the bottom surface and that extends in a forward-backward direction; and base portions that are disposed on both sides of the elevated portion, respectively, each of the base portions being stepped downward from the elevated portion.

5. A refrigerator comprising:

a cabinet comprising:

an inner case that defines a storage compartment, the inner case having a bottom surface that defines a water collection hole at a rear end, a case supporter that is coupled to a lower side of the inner case and that supports the inner case, a base that is coupled to a lower side of the case supporter, wherein the base and the case supporter define a cavity therebetween, a water collection guide mounted on the lower side of the inner case and configured to guide water downward from the water collection hole, and a water collection portion disposed on the base and configured to collect water from the water collection guide;

a door disposed on a front portion of the cabinet and configured to open and close at least a portion of the storage compartment; and a cooling device disposed on a rear surface of the inner case, at least a portion of the cooling device being exposed to the storage compartment, wherein the water collection guide comprises:

a contact portion that is coupled to and in contact with an outer surface of the inner case, and a water collection pipe having a guide hole configured to fluidly communicate with the water collection hole, wherein the case supporter comprises a guide pipe that receives the water collection pipe, and wherein the guide pipe has:

an upper end that extends upward from an upper surface of the case supporter and that connects to a lower end of the water collection pipe, and a lower end that extends downward from a lower surface of the case supporter and that is configured to guide water discharged from the water collection pipe toward the water collection portion.

6. The refrigerator of claim 5, wherein the water collection portion comprises a pipe cover rib that receives a lower end of the guide pipe.

7. The refrigerator of claim 6, wherein the pipe cover rib defines a slit that extends in a vertical direction.

8. The refrigerator of claim 6, wherein the water collection portion further comprises a vertical wall that protrudes upward from the base, that defines a storage space configured to store water from the guide pipe, and that surrounds the pipe cover rib.

9. The refrigerator of claim 8, wherein the pipe cover rib defines a slit that extends in a vertical direction and that is in communication with the storage space.

10. A refrigerator comprising:

a cabinet comprising:

an inner case that defines a storage compartment, the inner case having a bottom surface that defines a water collection hole at a rear end, a case supporter that is coupled to a lower side of the inner case and that supports the inner case, a base that is coupled to a lower side of the case supporter, wherein the base and the case supporter define a cavity therebetween, a water collection guide mounted on the lower side of the inner case and configured to guide water downward from the water collection hole, and a water collection portion disposed on the base and configured to collect water from the water collection guide;

a door disposed on a front portion of the cabinet and configured to open and close at least a portion of the storage compartment; and a cooling device disposed on a rear surface of the inner case, at least a portion of the cooling device being exposed to the storage compartment, wherein the cooling device comprises a fan that protrudes rearward relative to the rear surface of the inner case, and wherein the cabinet is configured to guide air discharged from the fan to an outside of the cabinet through the water collection portion.

11. The refrigerator of claim 10, wherein the cabinet further comprises a middle plate that covers an upper surface and the rear surface of the inner case, and a rear panel that covers a rear surface of the middle plate, wherein the fan is disposed between the middle plate and the rear panel, and wherein the cabinet is configured to guide air discharged from the fan downward through a space between the middle plate and the rear panel, and then to guide the air forward through the cavity defined between the case supporter and the base.

12. A refrigerator comprising:

a cabinet comprising:

an inner case that defines a storage compartment, the inner case having a bottom surface that defines a water collection hole at a rear end, a case supporter that is coupled to a lower side of the inner case and that supports the inner case, a base that is coupled to a lower side of the case supporter, wherein the base and the case supporter define a cavity therebetween, a water collection guide mounted on the lower side of the inner case and configured to guide water downward from the water collection hole, and a water collection portion disposed on the base and configured to collect water from the water collection guide;

a door disposed on a front portion of the cabinet and configured to open and close at least a portion of the storage compartment; and a cooling device disposed on a rear surface of the inner case, at least a portion of the cooling device being exposed to the storage compartment, wherein the inner case further comprises:

an elevated portion that protrudes upward from a center portion of the bottom surface and that extends in a forward-backward direction, and base portions that are disposed on both sides of the elevated portion, respectively, each of the base portions being stepped downward from the elevated portion, and wherein the refrigerator further comprises:

a first sensing member spaced apart from a front surface of the elevated portion; and a second sensing member that is disposed on the front surface of the elevated portion and that faces the first sensing member.

13. The refrigerator of claim 12, further comprising:

a drawer assembly connected to a lower side of the door and configured to move in the forward-backward direction with the door, wherein the first sensing member is disposed on a lower side of the drawer assembly and configured to sense distance from the second sensing member.

14. The refrigerator of claim 12, wherein one of the first sensing member or the second sensing member is a magnet, and the other of the first sensing member or the second sensing member is a Hall sensor configured to detect a magnetic field of the magnet.

* * * * *